US012011076B2

(12) United States Patent
Zhu et al.

(10) Patent No.: US 12,011,076 B2
(45) Date of Patent: Jun. 18, 2024

(54) COSMETIC PACKAGING TUBE

(71) Applicant: ZHEJIANG AXILONE SHUNHUA ALUMINUM & PLASTIC CO., LTD, Shaoxing (CN)

(72) Inventors: Weifeng Zhu, Shaoxing (CN); Yongqing Fang, Shaoxing (CN); Jianhua Song, Shaoxing (CN)

(73) Assignee: ZHEJIANG AXILONE SHUNHUA ALUMINUM & PLASTIC CO., LTD, Shaoxing (CN)

( * ) Notice: Subject to any disclaimer, the term of this patent is extended or adjusted under 35 U.S.C. 154(b) by 237 days.

(21) Appl. No.: 17/765,848

(22) PCT Filed: Jun. 28, 2020

(86) PCT No.: PCT/CN2020/098512
§ 371 (c)(1),
(2) Date: Apr. 1, 2022

(87) PCT Pub. No.: WO2021/068561
PCT Pub. Date: Apr. 15, 2021

(65) Prior Publication Data

US 2022/0338607 A1 Oct. 27, 2022

(30) Foreign Application Priority Data

Oct. 12, 2019 (CN) ..... 201910968508.3

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01)

(58) Field of Classification Search
CPC ..... A45D 40/06; A45D 2040/0025; A45D 40/00; A45D 2040/0062; A45D 40/02;
(Continued)

(56) References Cited

U.S. PATENT DOCUMENTS 1,835,580 A † 12/1931 Wild
1,835,590 A * 12/1931 Brown ..... H02B 11/02 361/607

(Continued)

FOREIGN PATENT DOCUMENTS

CN 1240118 A 1/2000
CN 202653454 U 1/2013

(Continued)

OTHER PUBLICATIONS

International Search Report issued in corresponding International application No. PCT/CN2020/098512, mailed Oct. 10, 2020.

(Continued)

*Primary Examiner* — David J Walczak

(57) ABSTRACT

A center tube core includes a prong, a spiral rotatably sleeved on the prong, and a bead slidably mounted in the prong so as to carry a product. The side wall of the prong is provided with a slide slot that extends axially, the outer wall of the bead is provided with a slide block that extends radially out from the slide slot, and the inner wall of the spiral is provided with a feeding thread that acts on the slide block. The prong, the bead and the spiral are all made using a metal material.

21 Claims, 10 Drawing Sheets

(58) Field of Classification Search
CPC ..... A45D 40/205; A45D 2040/208; B65D 83/0005
USPC ..... 401/68, 75, 77, 88
See application file for complete search history.

(56) References Cited

U.S. PATENT DOCUMENTS

| | | | | | |
|---|---|---|---|---|---|
| 2,104,902 | A | † | 1/1938 | Morrison | |
| 2,797,803 | A | † | 7/1957 | Hopgood | |
| 2,838,169 | A | | 6/1958 | Grau | |
| 2,896,778 | A | | 7/1959 | Hopgood | |
| 3,272,327 | A | | 9/1966 | Busch | |
| 3,298,509 | A | † | 1/1967 | Hultgren | |
| 5,871,295 | A | * | 2/1999 | Bouix | A45D 40/06 401/86 |
| 5,934,814 | A | † | 8/1999 | Matsuoka | |
| 6,082,372 | A | † | 7/2000 | Mizukaki | |
| 6,116,801 | A | | 9/2000 | Patel et al. | |
| 6,244,770 | B1 | | 6/2001 | Holloway | |
| 6,290,414 | B1 | | 9/2001 | Seebach, Jr. et al. | |
| 11,633,031 | B2 | * | 4/2023 | Lin | A45D 40/02 206/385 |

FOREIGN PATENT DOCUMENTS

| | | | | | |
|---|---|---|---|---|---|
| CN | 203597535 | U | | 5/2014 | |
| CN | 203662194 | U | | 6/2014 | |
| CN | 107232736 | A | | 10/2017 | |
| CN | 207837036 | U | | 9/2018 | |
| CN | 109770522 | A | | 5/2019 | |
| FR | 2657822 | | * | 7/1990 | B65D 17/50 |
| FR | 2657822 | | † | 8/1991 | |
| FR | 2657822 | A1 | | 8/1991 | |
| JP | H10127339 | A1 | | 5/1998 | |
| JP | 4121593 | B2 | | 7/2008 | |
| JP | 2016527019 | A | | 9/2016 | |
| KR | 20130006615 | U | | 11/2013 | |

OTHER PUBLICATIONS

Written Opinion of the International Searching Authority for No. PCT/CN2020/098512.
China Notification of first office action, China Application No. CN202080067606.0, mailed Mar. 6, 2023.
European Search Report issued in corresponding application No. 20873786.6. mailed Nov. 21, 2023(14 pages).
Supplementary Partialeuropean Search Report issued in EP application No. 20873786.6, mailed Aug. 29, 2023.

* cited by examiner
† cited by third party

COSMETIC PACKAGING TUBE

TECHNICAL FIELD

The present application relates to the field of product packaging, in particular to an all-metal center tube core, a cosmetic packaging tube including the center tube core, and a processing method of the center tube core and the packaging tube.

BACKGROUND

Packaging tube is a carrier of cosmetics such as lipstick, and center tube core is its core component, which generally includes a prong, a bead and a spiral. In order to make the appearance of the product beautiful, the spiral of some product is surrounded by a middle bundle of metal material, or the prong of some products is made of metal material, while most of other components are made by injection molding of polymer materials due to the restrictions of the process. With the demanding of environmental protection, people hope that plastics and other materials can be recycled and reused. As mentioned above, most of the existing packaging tubes are made of metal and plastic, which are always difficult to recycle and reuse.

SUMMARY OF THE INVENTION

Technical Problem

The present application provides a center tube core made of all metal material, which solves the problem that the traditional center tube core is difficult to be recycled and reused.

Solution for Solving the Technical Problem

Technical Solution

The center tube core comprises a prong, a spiral rotatably surrounding the prong and a bead slidably provided in the prong for supporting product, wherein a side wall of the prong is provided with a slide slot extending in an axial direction, an outer wall of the bead is provided with a slide block extending out of the slide slot in a radial direction, and an inner wall of the spiral is provided with a feed thread acting on the slide block, and wherein the prong, the bead and the spiral are all made of metal material.

In the following, a number of alternatives are provided, but not as additional limitations to the above-mentioned general subject matter, and merely as further additions or preference. Without technical or logical contradiction, the alternatives can be combined individually with the above-mentioned general subject matter, or can be combined among them.

Optionally, the metal material is aluminum or aluminum alloy.

Optionally, the prong, the bead and the spiral are all made of the same metal material.

Optionally, a part of a side wall of the bead protrudes radially outwardly to form the slide block.

Optionally, at least two slide blocks are evenly distributed along a circumferential direction of the bead.

Optionally, the slide block is integrally engaged with the feed thread, or a surface of the slide block is provided with one or more ridges that are engaged with the feed thread.

Optionally, the inner wall of the spiral forms the feed thread by cutting.

Optionally, the feed thread is formed by deformation of a tube wall of the spiral.

Optionally, the feed thread comprises a threaded bottom wall and two opposed threaded sidewalls, and an included angle between the threaded sidewall and the threaded bottom wall is 90 degrees to 145 degrees.

Optionally, an inner wall of the bead is provided with a limiting protrusion for engaging the product.

Optionally, a part of a side wall of the bead is cut to form a tab, and the tab is bent radially inward to form the limiting protrusion.

Optionally, separable portions of the tab from the side wall of the bead includes three transverses connected in sequence, respectively:

- a first transverse extending along a circumferential direction of the bead;
- a second transverse extending from one end of the first transverse toward a top end along an axial direction of the bead; and
- a third transverse extending from the other end of the first transverse toward the top end along the axial direction of the bead.

Optionally, separable portions of the tab from the side wall of the bead includes three transverses connected in sequence, respectively:

- a fourth transverse extending along an axial direction of the bead;
- a fifth transverse extending from one end of the fourth transverse in a circumferential direction of the bead; and
- a sixth transverse extending from the other end of the fourth transverse in the circumferential direction of the bead, wherein the fifth transverse and the sixth transverse are located at the same side of the fourth transverse.

Optionally, the bead comprises an inner cylinder and an outer cylinder surrounded one around the other, and wherein an outer wall of the outer cylinder is provided with the slide block.

Optionally, an inner wall of the inner cylinder is provided with axially extending ribs for engaging with the product.

Optionally, the ribs are formed by radially inward depression of a wall of the inner cylinder.

The present application further provides a cosmetic packaging tube comprising the center tube core above, a top cover and a base.

Optionally, the prong comprises a first inner section extending into the spiral and a first operation section located axially outside a bottom end of the spiral, wherein the slide slot is defined in the first inner section, the base is fixedly connected with the first operation section, the spiral is at least partially exposed outside the base, and the exposed portion has a smooth outer wall surface.

Optionally, a positioning step is provided between the first inner section and the first operation section, and the bottom end of the spiral abuts against the positioning step.

Optionally, an outer peripheral surface of the spiral is flush with an outer peripheral surface of the first operation section.

Optionally, a bottom end of the first operation section is provided with a closing plate.

Optionally, an outer wall of the prong is provided with a positioning groove extending in a circumferential direction, and the inner wall of the spiral is provided with a positioning protrusion engaged with the positioning groove.

Optionally, the positioning groove is formed by deformation of a tube wall of the prong.

Optionally, the positioning protrusion is formed by deformation of a tube wall of the spiral.

Optionally, a plurality of positioning protrusions are provided and evenly distributed along a circumferential direction of the spiral.

Optionally, an outer wall of the prong is provided with a positioning groove extending in a circumferential direction, and the inner wall of the spiral is provided with an annular positioning protrusion extending in a circumferential direction and engaged with the positioning groove.

Optionally, the prong comprises a second inner section extending into the spiral and a second operation section located axially outside a top end of the spiral, and wherein the slide slot is defined in the second inner section, the spiral is fixedly connected with the base and is accommodated in the base.

Optionally, an outer wall of the spiral has a deformation corresponding to the feed thread.

Optionally, the second operation section extends into the top cover.

Optionally, the bead is an axially penetrated tubular structure and comprises a product supporting portion and an extension portion distributed in an axial direction of the bead, and wherein the slide block is provided at the extension portion and the tubular structure has a reduced diameter region between the product supporting portion and the extension portion, and the reduced diameter region forms a product stop ring on an inner wall of the tubular structure.

Optionally, the base, the spiral, and the prong are each provided with an avoidance opening corresponding to an inner cavity of the tubular structure.

Optionally, a middle sleeve is fixedly inserted into an opened portion of the base, a gap is defined between the middle sleeve and the spiral in an axial direction of the base, which serves as an axial positioning groove, and a positioning ring is inserted into the axial positioning groove arranged on an outer periphery of the prong.

Optionally, the side wall of the prong protrudes radially outwardly to form the positioning ring.

Optionally, the spiral and the middle sleeve are both in an interference fit with the base.

Optionally, one axial end of the base is provided with an opening for insertion of the prong and the other axial end is provided with a through hole whose periphery is an annular inner flange, and wherein an end of the spiral abuts against the inner flange.

Optionally, the base is made of metal material and has a smooth outer peripheral surface.

The present application also provides a processing method for a center tube core for processing the center tube core as described.

Advantages of the Invention

Advantages

In the application, the center tube core is made of metal material, the product does not need to be disassembled during recycling, and can be recycled directly, with a simple and convenient operation.

BRIEF DESCRIPTION OF THE DRAWINGS

Drawings Description

Figure 1:
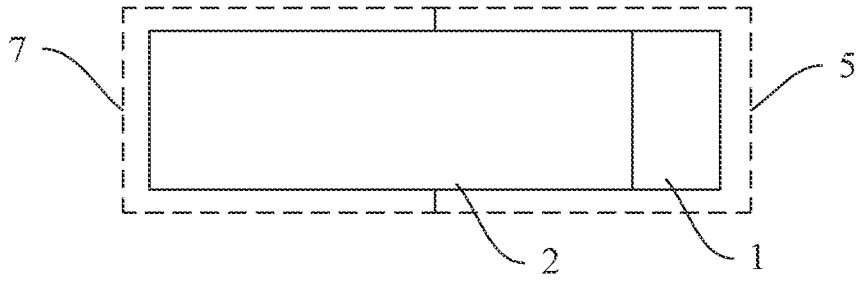
FIG. 1 is a schematic structural view of a cosmetic packaging tube according to an embodiment.

In the figures, reference numerals are listed below:

1, prong; 11, slide slot; 12, positioning groove; 13, positioning ring; 14, first inner section; 15, first operation section; 16, positioning step; 17, closing plate; 18, second inner section; 19, second operation section; 2, spiral; 21, feed thread; 211, threaded bottom wall; 212, threaded sidewall; 22, positioning protrusion; 23, annular positioning protrusion; 24, flange; 3, bead; 31, slide block; 301, outer cylinder; 302, inner cylinder; 303, rib; 311, ridge, 32, limiting protrusion, 321, connecting end, 322, free end, 323, first transverse, 324, second transverse, 325, third transverse, 326, fourth transverse, 327, fifth transverse, 328, sixth transverse; 33, supporting portion; 34, extension portion; 35, product stop ring; 4, avoidance opening; 5, base; 51, inner flange; 6, middle sleeve; 61, first insertion portion; 62, second insertion portion; 63, limiting ring; 7, top cover.

EMBODIMENTS OF THE INVENTION

Description of the Embodiments

The technical solutions according to the embodiments of the present disclosure will be described in combination with the drawings according to the embodiments of the present disclosure. The described embodiments represent some but not all the possible embodiments.

It should be noted that, when a component is "connected" with another component, it may be directly connected to another component or may be indirectly connected to another component through a further component. When a component is "provided" on another component, it may be directly provided on another component or may be provided on another component through a further component.

Unless otherwise defined, all technical and scientific terms used herein have the same meaning as commonly understood by a person skilled in the art. The terms in the description of the present disclosure are used to describe specific embodiments, and not to limit the present disclosure. The term "and/or" used herein includes any combinations of one or more of the listed options, as well as the combination of all of the listed options.

Figure 2:
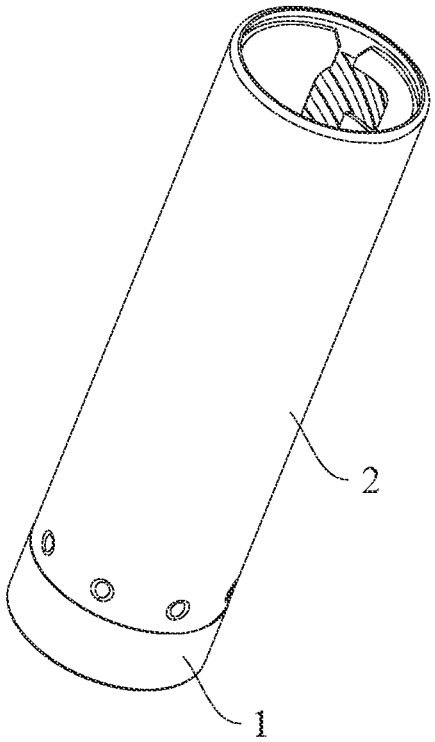
FIG. 2 is a schematic structural view of a center tube core shown in FIG. 1.
Figure 3:
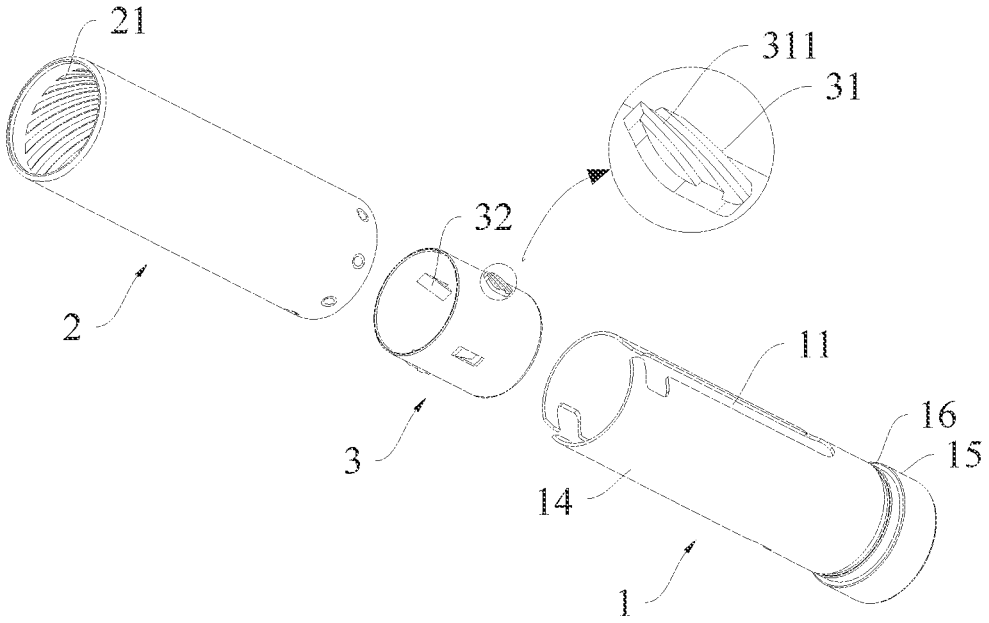
FIG. 3 is an exploded view of the center tube core shown in FIG. 2.

In one embodiment, as shown in FIG. 1, a cosmetic packaging tube includes a base 5, a top cover 7 and a center tube core, and the center tube core is located inside a chamber defined by the base 5 and the top cover 7. As shown in FIG. 2 and FIG. 3, the center tube core includes a prong 1, a spiral 2 rotatably surrounding the prong 1, and a bead 3 slidably mounted in the prong 1 for supporting product. The side wall of the prong 1 is provided with an axially extending slide slot 11. The outer wall of the bead 3 has a slide block 31 extending radially out of the slide slot 11. The inner wall of the spiral 2 has a feed thread 21 acting on the slide block 31.

The axial direction, i.e., the longitudinal direction of the center tube core, is also the direction of moving forth and back of the bead 3 in use, and the radial direction is a direction perpendicular to the axial direction. In use, the spiral 2 is rotated relative to the prong 1 to change the overlapping area of the feed thread 21 and the slide slot 11, so that the bead 3 and the product can move forth and back in the axial direction.

In this embodiment, the prong 1, the bead 3 and the spiral 2 are made of metal, with the same processing, thereby reducing the manufacturing cost and facilitating the recycling. Specifically, the metal material is aluminum or an aluminum alloy.

Figure 4:
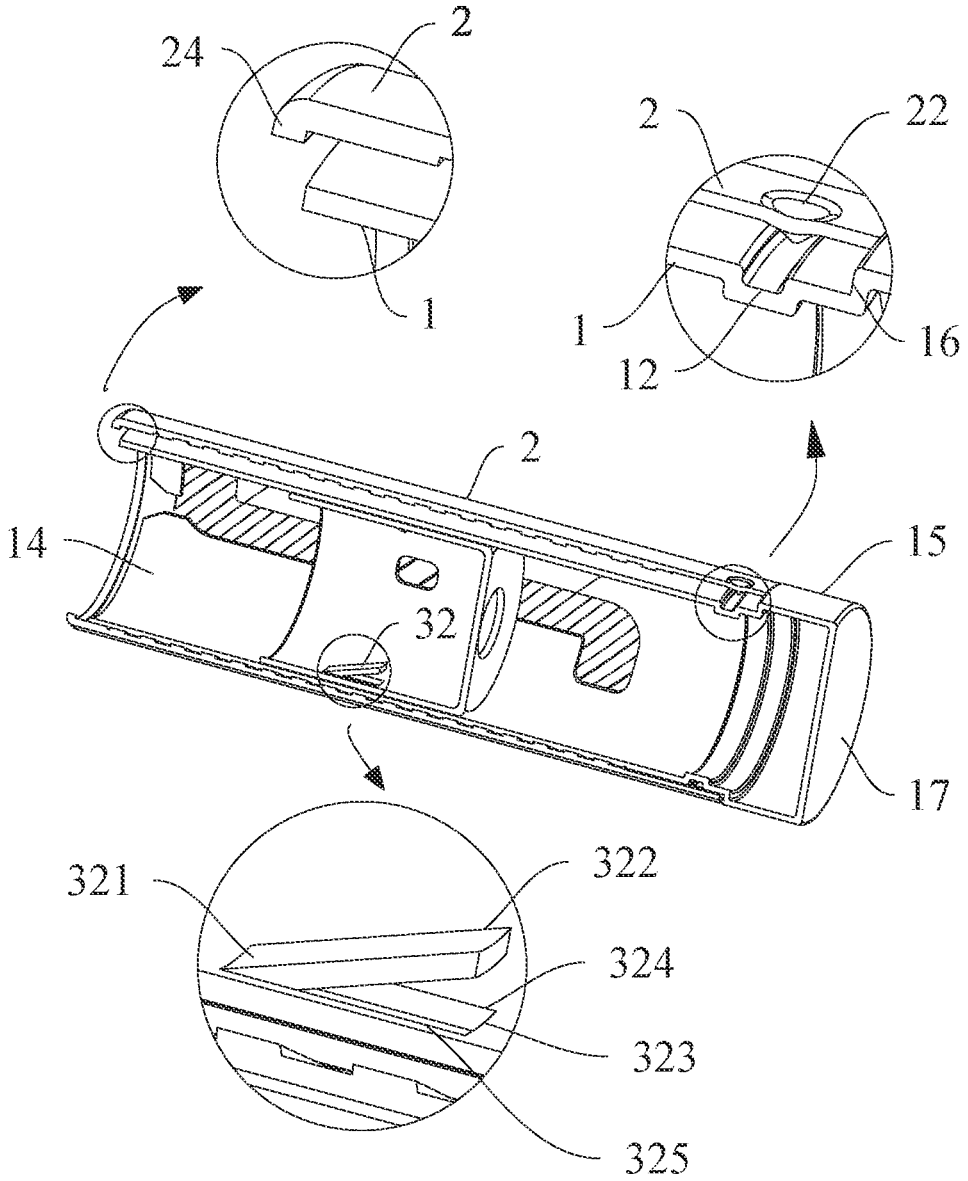
FIG. 4 is an internal structural view of the center tube core shown in FIG. 2.

In one embodiment, as shown in FIGS. 3 and 4, the prong 1 includes a first inner section 14 extending into the spiral 2, and a first operation section 15 axially outward of the bottom end of the spiral 2, wherein the slide slot 11 is defined in the first inner section 14. The user drives the bead 3 to retract into or extend from the center tube core by approaching the first operation section 15 and the spiral 2, respectively, and rotating them relative to each other.

In one embodiment, as shown in FIG. 1, FIG. 2 and FIG. 3, the first operation section 15 is fixedly connected with the base 5 with an interference fit, an adhesive fit, or other fitting. In operation, the user only needs to hold the base. In this case, at least part of the spiral 2 is exposed outside the base 5, and the exposed part has a smooth out surface, with a good touch feeling and visual effect and the traditional center bundle omitted.

Figure 5:
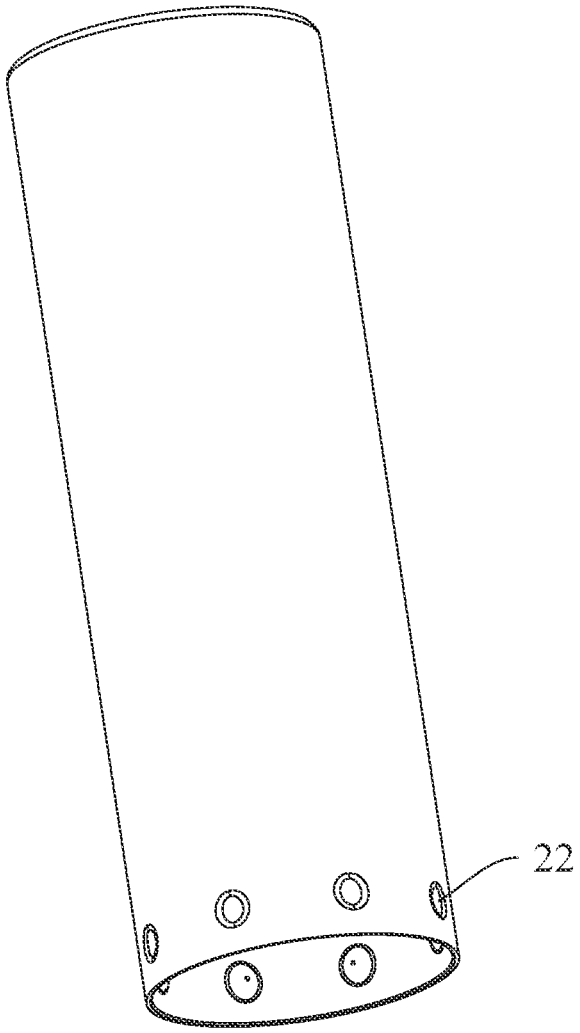
FIG. 5 is a schematic view of a spiral according to an embodiment.

In order to axially fix the spiral 2 and the prong 1, as shown in FIGS. 4 and 5, the outer wall of the prong 1 is provide with a positioning groove 12 extending in the circumferential direction, and the inner wall of the spiral 2 is provided with a positioning protrusion 22 which fits into the positioning groove 12. The positioning groove 12 can be formed by deformation of the tube wall of the prong 1. The positioning protrusion 22 can be formed by deformation of the tube wall of the spiral 2. A plurality of positioning protrusions 22 can be provided and distributed in the circumferential direction of the spiral 2. In assembly, the spiral 2 surrounds the outside of the prong 1 in such a way that positioning projections 22 are engaged in the positioning groove 12, thereby fixing the relative axial position of the prong 1 and the spiral 2 and allowing the prong 1 to rotate relative to the spiral 2. The opening of the top end of the spiral 2 is provided with a flange 24 for limiting against the top end of the prong 1.

Figure 6:
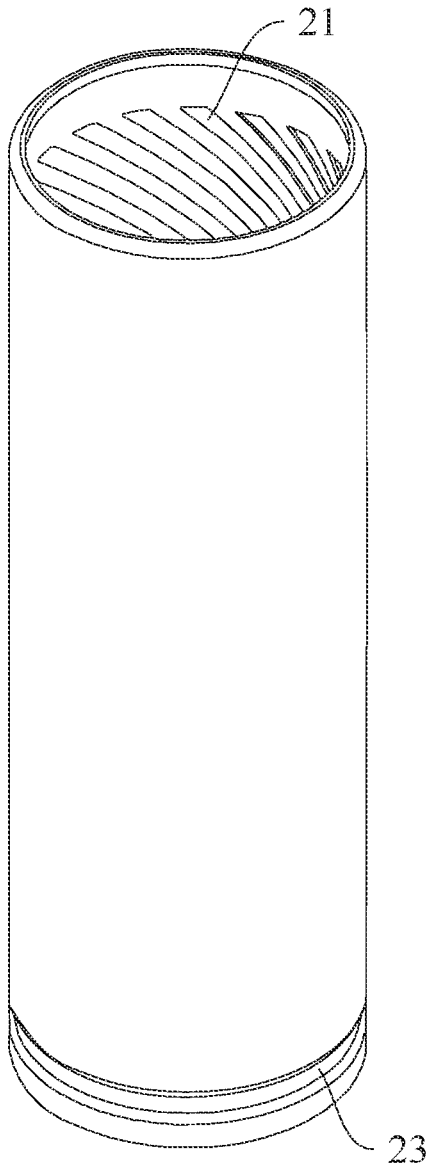
FIG. 6 is a schematic structural view of a spiral according to another embodiment.

In one embodiment, as shown in FIG. 6, the outer wall of the prong 1 is provided with a positioning groove extending in the circumferential direction, and the inner wall of the spiral 2 is provided with an annular positioning protrusion 23 extending in the circumferential direction, and the annular positioning protrusion 23 is engaged in the positioning groove.

In one embodiment, as shown in FIG. 4, a positioning step 16 is defined between the first inner section 14 and the first operation section 15, and the bottom end of the spiral 2 abuts against the positioning step 16. As shown in FIG. 1, the outer peripheral surface of the spiral 2 is flush with the outer peripheral surface of the first operation section 15, so as to increase the aesthetic appearance of the product and reduce the possible bumping area with the environment.

As shown in FIG. 4, the bottom end of the first operation section 15 is provided with a closing plate 17. The closing plate 17 closes the bottom end of the prong 1 to prevent external contaminants from entering through the bottom end of the bead 3 and contaminating the paste in the bead 3. In one embodiment, the axial length of the first operation section 15 is ⅛ to ⅕ of the axial length of the prong 1.

Figure 11:
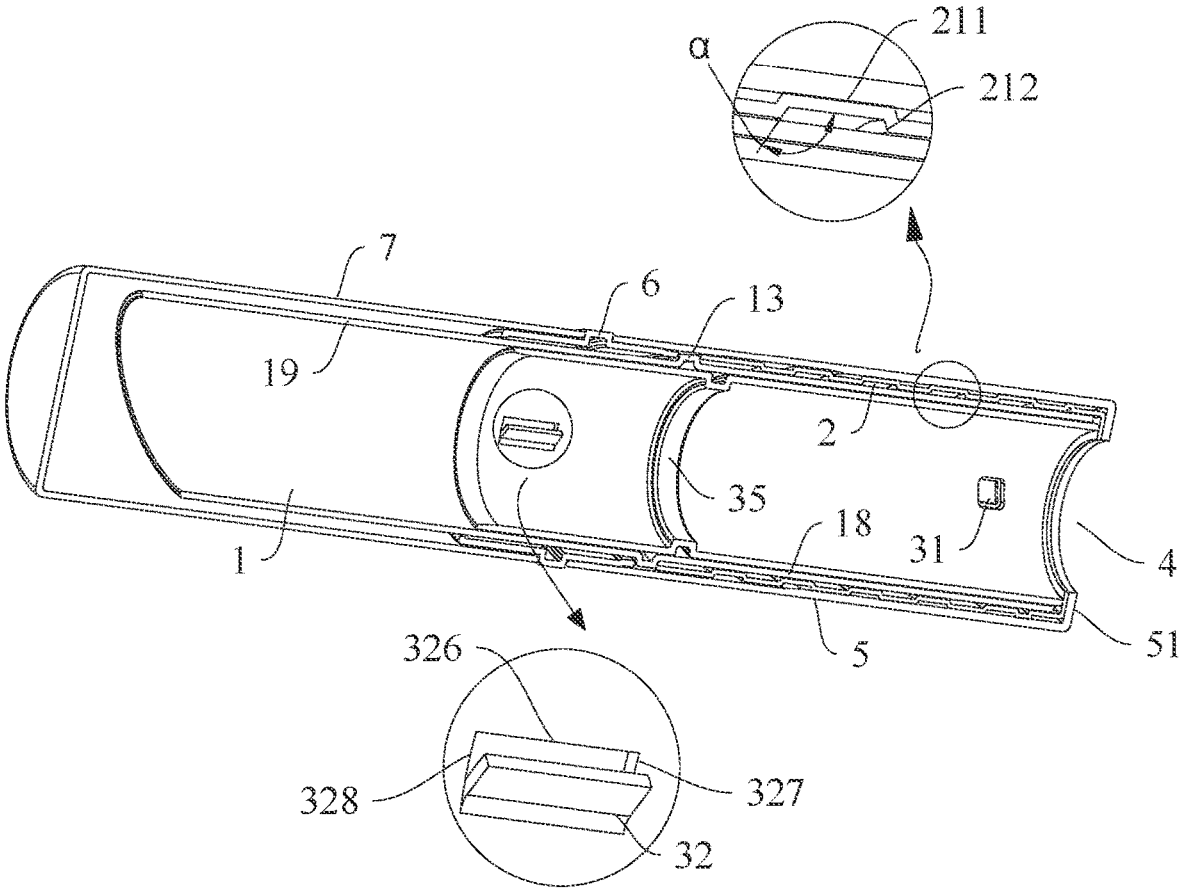
FIG. 11 is a view showing the inner structure of the cosmetic packaging tube shown in FIG. 10.
Figure 12:
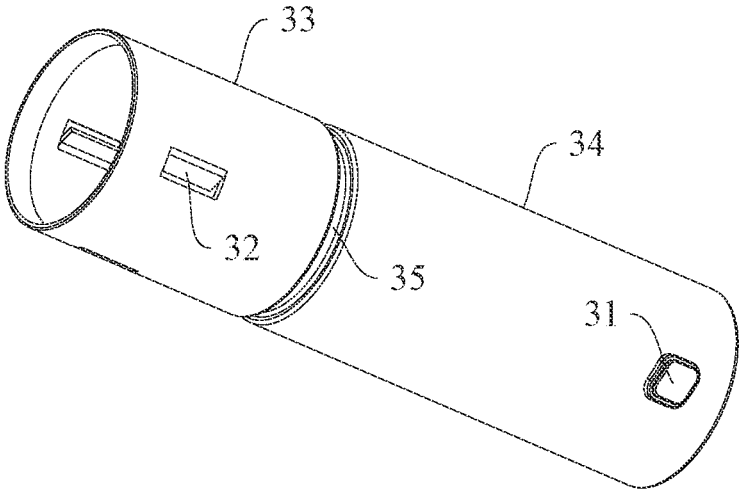
FIG. 12 is a schematic structural view of a bead shown in FIG. 10.

In one embodiment, a part of the side wall of the bead 3 projects radially outwardly to form the slide block 31. For example, a portion of the metal tube wall can be drawn outwardly to form the slide block 31. In particular, at least two slide blocks 31 are evenly distributed in the circumferential direction of the bead 3. As shown in FIGS. 11 and 12, the slide block 31 is integrally engaged into the feed thread 21.

Specifically, in one embodiment, as shown in FIG. 3, one or more ridges 311 are formed on the surface of the slide block 31, and each ridge 311 is engaged into the feed thread 21. For example, the slide block 31 is made of a metal material, and a precise ridge structure can be formed by a drawing process. The feed thread 21 is also made of a metal material to ensure the precise fitting with the ridge 311. A ridge 311 is engaged into one of the feed threads 21 so that one slide block 31 is simultaneously engaged with a plurality feed threads 21, thereby dispersing the contact stress between the slide block 31 and the feed threads 21, preventing local excessive deformation, and improving the sliding stability of the bead 3.

There are various ways of forming the feed thread 21, and in one embodiment, the feed thread 21 is formed on the inner wall of the spiral 2 by cutting. In another embodiment, the spiral 2 forms the feed thread 21 by deformation of the tube wall itself.

In particular, in one of the embodiments, the feed thread 21 can be formed by rolling the wall of the spiral 2 in combination of rotation and axial feed.

In particular, in one of the embodiments, the tube having a smooth outer peripheral surface is pressed by a die inside and outside the tube, respectively, so that the inner peripheral surface of the tube forms the feed thread 21.

In one embodiment, as shown in FIG. 11, the feed thread 21 includes a threaded bottom wall 211 and two opposed threaded sidewalls 212, and an included angle (i.e., angle a shown in FIG. 11) between the threaded sidewall 212 and the threaded bottom wall 211 is 90 degrees to 145 degrees.

The product is generally a paste. In order to ensure that the product is firmly fixed in the bead 3, the inner wall of the bead abuts against or is inserted into the paste through a limiting protrusion 32, thereby further preventing the product from sliding along the axial direction.

The pasty product can be pre-molded and then axially loaded into the bead 3, or be molded by injecting the starting material into the bead 3. There are various ways of processing the limiting protrusion 32. For example, the side wall of the bead 3 can be pressed inward in such a way that a part of the side wall is deformed to protrude inward, and the outside of the bead 3 is concaved.

In order to facilitate the axial loading of the pre-cured product into the bead 3, preferably, a part of the side wall of the bead 3 is cut to form a tab, which is bent radially inward to form the limiting protrusion. Specifically, slot(s) can be cut on the metal side wall of the bead 3 along a non-closed path, and then the tab partially surrounded by the slot(s) is pushed inward to form the limiting protrusion 32.

In one embodiment, as shown in FIG. 4, the separable portion of the tab from the side wall of the bead includes three transverses connected in sequence, i.e., a first transverse 323 extending along the circumferential direction of the bead, a second transverse 324 extending from one end of the first transverse 323 toward the top along the axial direction of the bead, and a third transverse 325 extending from the other end of the first transverse 323 toward the top along the axial direction of the bead, respectively.

In another embodiment, as shown in FIG. 11, the separable portion of the tab from the side wall of the bead includes three transverses connected in sequence, i.e., a fourth transverse 326 extending axially along the bead, a fifth transverse 327 extending circumferentially from one end of the fourth transverse 326, and a sixth transverse 328 extending circumferentially from the other end of the fourth transverse 326. The fifth transverse 327 and the sixth transverse 328 are on the same side of the fourth transverse 326.

Specifically, as shown in FIGS. 4 and 11, the tab has a connecting end 321 connected to the side wall of the bead 3, and a free end 322 extending inside the bead 3, the connecting end 321 being closer to the entrance of the bead 3 than the free end 322. When the product is loaded into the bead 3, the limiting protrusion 32 of the metal plate structure avoids the product through an elastic deformation, thereby reducing the resistance to the product loading. After the product is loaded into the bead 3, when there is a tendency for the product to come out of the bead 3 in the axial direction, the free end 322 is inserted into the paste of the product to form a barbed structure to prevent the product from coming out of the bead 3.

Figure 7:
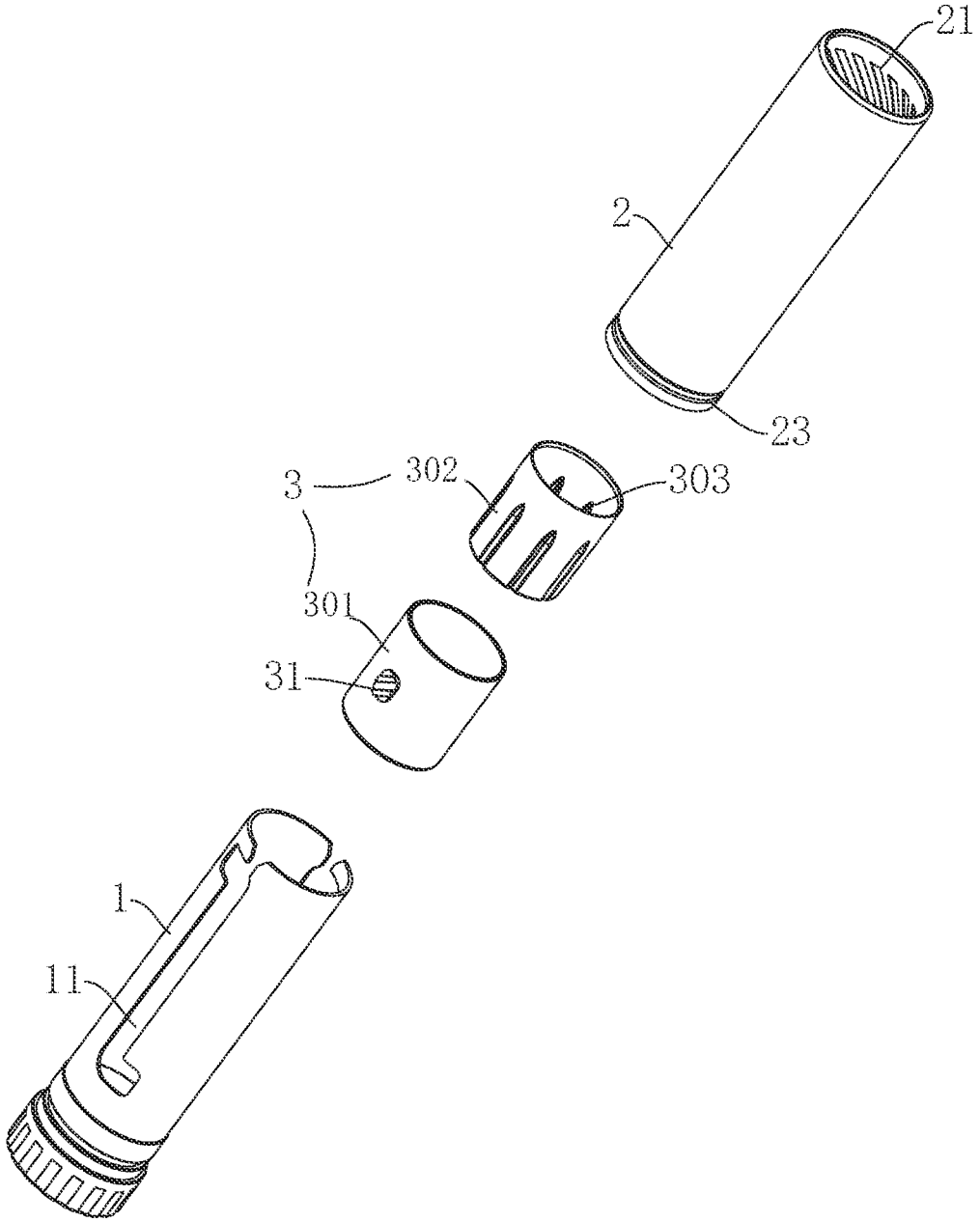
FIG. 7 is an exploded view of a center tube core according to another embodiment.
Figure 8:
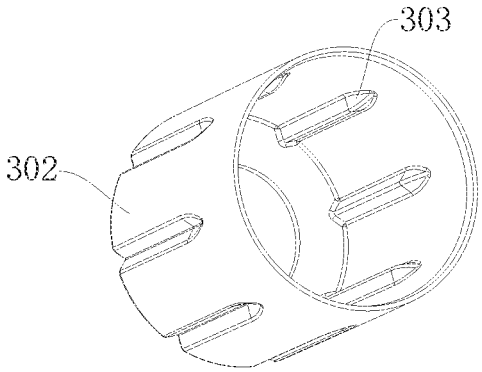
FIG. 8 is a schematic structural view of an inner cylinder shown in FIG. 7.
Figure 9:
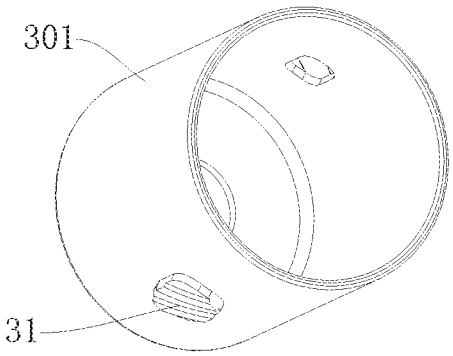
FIG. 9 is a schematic structural view of an outer cylinder shown in FIG. 8.

In one embodiment, as shown in FIGS. 7, 8 and 9, the bead 3 includes an outer cylinder 301 and an inner cylinder 302, the outer cylinder 301 is provided with the slide block 31, and the inner cylinder 302 is provided with an axially extending rib 303. The bottom end of the bead 3 is a base, and the top end of the bead 3 is a mouth. The height of the rib 303 in the radial direction gradually decreases as the rib 303 extends from the base toward the mouth. In one embodiment, the rib 303 is formed by a radially inwardly recession of the wall of the inner cylinder. The rib 303 functions as a limiting protrusion and is mainly used to limit the paste to fall off.

Figure 10:
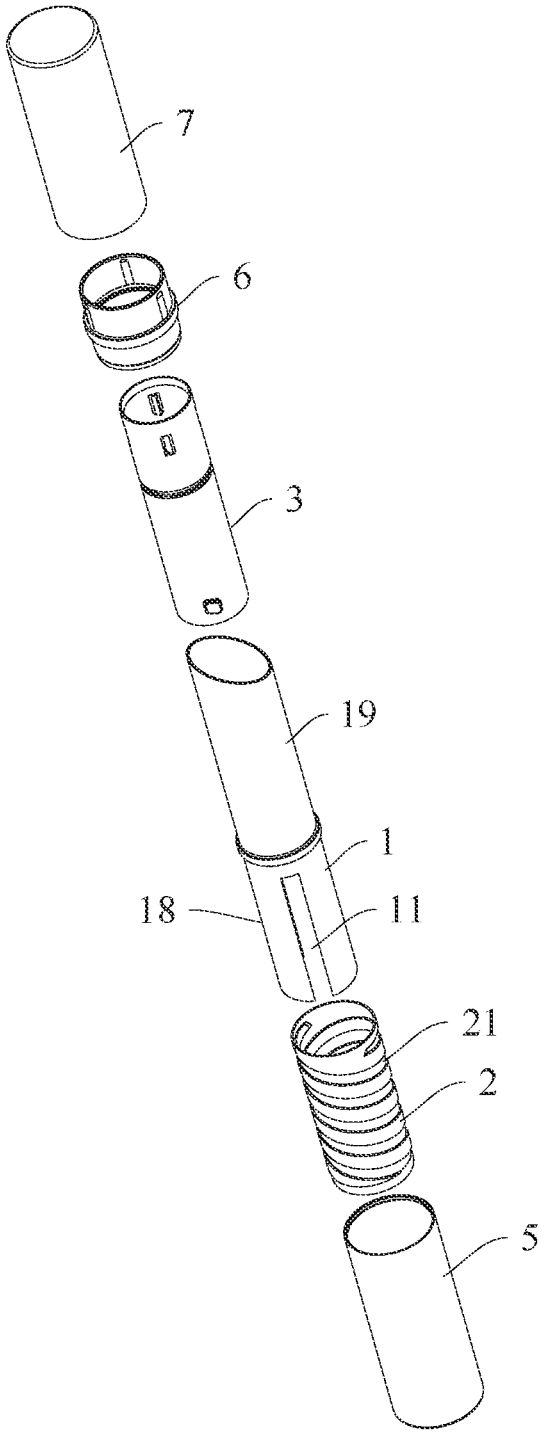
FIG. 10 is an exploded view of a cosmetic packaging tube according to another embodiment.

In another embodiment, as shown in FIGS. 10 and 11, the cosmetic packaging tube includes a base 5, a top cover 7 and a center tube core which is located in a chamber defined by the base 5 and the top cover 7. The center tube core includes a prong 1, a spiral 2 rotatably surrounding the prong 1, and a bead 3 slidably mounted in the prong 1 for supporting product. The side wall of the prong 1 is provided with an axially extending slide slot 11. The outer wall of the bead 3 has a slide block 31 extending radially out of the slide slot 11. The inner wall of the spiral 2 has a feed thread 21 acting on the slide block 31.

In this embodiment, the prong 1, the bead 3 and the spiral 2 are all made of metal.

As shown in FIG. 10 and FIG. 11, the prong 1 includes a second inner section 18 extending into the spiral 2, and a second operation section 19 located outside the top end of the spiral 2 in the axial direction. The slide slot 11 is defined in the second inner section 18.

In assembly, the base 5 is fixedly connected to the spiral 2, the spiral 2 is integrally received in the base 5, and the second operation section 19 is exposed from the base 5. The base 5 and the spiral 2 are generally connected by an interference fit, although can be connected by bonding or the like.

In an embodiment, as shown in FIG. 10, FIG. 11 and FIG. 12, the bead 3 is an axially penetrated tubular structure, and includes a product supporting portion 33 and an extension portion 34 distributed in the axial direction of the bead 3. The slide block 31 is provided on the extension portion 34. The limiting protrusion 32 is provided on the product supporting portion 33. The tubular structure has a reduced diameter region between the product supporting portion 33 and the extension portion 34, which forms a product stop ring 35 on the inner wall of the tubular structure. The limiting protrusion 32 mainly prevents the product from rotating, and the product stop ring 35 mainly prevents the product from sliding in the axial direction.

As shown in FIGS. 10 and 11, the outer wall of the spiral 2 has a deformation corresponding to the feed thread 21. The feed thread 21 in this embodiment is produced by deformation of the tube wall of the spiral 2 in the radial direction, which causes the outer wall of the spiral 2 to have an uneven structure. It should be noted that "smooth" used herein is a term relative to the uneven structure corresponding to the feed thread 21 in form, and the surface roughness of the material used for the spiral 2 is not strictly limited. A spiral 2 having a rough outer peripheral surface is also within the scope of the present application.

The term of "all-metal" used herein refers to the three main parts, namely, the prong 1, the bead 3 and the spiral 2. Undoubtedly, the center tube core may also include other additional parts, and the material of these additional parts is not strictly limited.

In one embodiment, the base 5 and the top cover 7 are also made of metal and have smooth outer peripheral surfaces.

In one embodiment, the prong 1, the bead 3, the spiral 2 and the base 5 are made of the same metal.

The spiral 2, the prong 1 and the base 5 are each provided with an avoidance opening 4 corresponding to the inner cavity of the tubular structure, and by providing the avoidance opening 4, the product can be loaded into the center tube core from the bottom end.

One axial end of the base 5 is provided with an opening for the insertion of the center tube core, and the other axial end is provided with a through hole whose periphery is an annular inner flange 51 against which the end of the spiral 2 abuts.

A middle sleeve 6 is fixedly inserted into the opening of the spiral 2, and a gap is defined between the middle sleeve 6 and the spiral 2 in the axial direction of the base 5, which serves as an axial positioning groove. A positioning ring 13 is inserted into the axial positioning groove on the outer periphery of the prong 1. The side wall of the prong 1 projects radially outwards to form the positioning ring 13.

Figure 13:
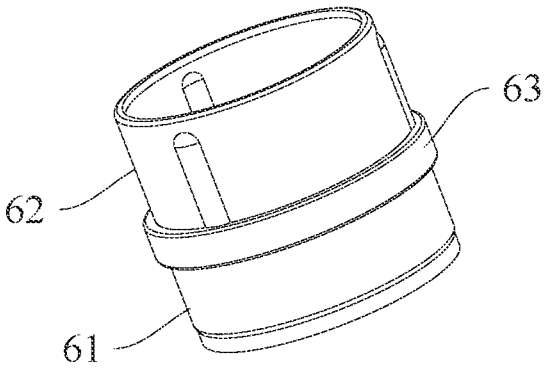
FIG. 13 is a schematic structural view of a middle sleeve shown in FIG. 10.

As shown in FIG. 13, the middle sleeve 6 is an axially penetrated tubular structure, and includes a first insertion portion 61 and a second insertion portion 62 distributed in the axial direction of the middle sleeve 6. The first insertion portion 61 and the second insertion portion 62 are separated by a limiting ring 63. The first insertion portion 61 is inserted into the base 5 and fixed to the base 5 by interference fit.

In one embodiment, the production process of the all-metal center tube core includes: processing the side wall of the bead 3 to form the slide block 31 that protrudes radially outwardly, and forming the inwardly turned tab by cutting the side wall of the bead 3; assembling the bead 3 into the prong 1 with the slide slot 11 on the side wall thereof in such a way that the slide block 31 extends radially out of the slide slot 11; forming the feed thread 21 acting on the slide block 31 on the inner wall of the spiral 2 having a smooth outer peripheral surface; and assembling the prong 1 into the spiral 2 in such a way that the slide block 31 is engaged with the feed thread 21.

In another embodiment, the bead 3 is formed by assembling the outer cylinder 301 and the inner cylinder 302 by interference fit, wherein the outer cylinder 301 is machined at the side wall thereof to form a slide block that protrudes radially outwardly, and the inner cylinder 302 is machined at the side wall thereof to form the rib 303 that is radially recessed.

In another embodiment, a die is used to extrude a tube inside and outside, respectively, so that the inner peripheral surface of the tube forms the feed thread 21, and the outer peripheral surface of the tube forms a deformation corresponding to the feed thread 21.

In one embodiment, as shown in FIGS. 4 and 5, the assembly of the prong 1 with the spiral 2 includes: forming the circumferentially extending positioning groove 12 on the prong 1; forming the plurality of positioning protrusions 22 evenly distributed along the circumferential direction on the inner wall of the spiral 2; and surrounding the spiral 2 around the prong 1 in such a way the positioning protrusions 22 are engaged into the positioning groove 12.

In another embodiment, as shown in FIG. 6, the assembly of the prong 1 with the spiral 2 includes: surrounding the spiral 2 around the prong 1; extruding the spiral 2 and the prong 1 simultaneously inside the prong 1 and outside the spiral 2 to form the circumferentially extending positioning groove 12 on the prong 1 and the circumferentially extending annular positioning protrusion 23 on the inner wall of the spiral 2 and engaged into the positioning groove.

The present application further provides a process for the cosmetic packaging tube. In one embodiment, the base 5 is fixedly connected with the bottom of the prong 1, the top cover 7 is surrounded around the center tube core. As shown in FIG. 1, the top cover 7 is engaged with the base 5, and the center tube core is received in an interior space where the two are enclosed.

In another embodiment, the base 5 is in an interference fit with the spiral 2 such that the spiral 2 is completely received within the base. The mouth of the base 5 is provided with the middle sleeve 6, which is inserted into the base and in an interference fit therewith, and cooperates with the spiral 2 to limit the axial movement of the prong. The top cover 7 surrounds around the exposed part of the center tube core, and cooperates with the base 5 and the middle sleeve 6 to enclose the center tube core in the inner space of the three.

The features described in the above various embodiments may be combined. In order to simplify the descriptions, not all possible combinations of the features in the above embodiments have been described. However, any combinations of the features should be within the scope of the invention as long as no conflict resides between these features. In the case where the features in different embodiments are shown in the same drawing, it may be considered that this drawing discloses a combination of the various embodiments involved.

The above embodiments are only several implementations of the present invention which are described specifically and in detail, without limitation to the scope claimed by the present invention. Those skilled in the art can make various modifications and variations to the embodiments without departing from the spirit and scope of the present invention, and these modifications and variations should fall into the scope claimed by the present invention. Therefore, the scope of protection of the invention patent should be subject to the attached claims.

What is claimed is:

1. A center tube core, comprising a prong, a spiral rotatably surrounding the prong and a bead slidably provided in the prong for supporting a product, wherein a side wall of the prong is provided with a slide slot extending in an axial direction, an outer wall of the bead is provided with a slide block extending out of the slide slot in a radial direction, and an inner wall of the spiral is provided with a feed thread acting on the slide block, and wherein the prong, the bead and the spiral are all made of metal material; and wherein the bead comprises an inner cylinder and an outer cylinder surrounding the inner cylinder, and an outer wall of the outer cylinder is provided with the slide block.

2. The center tube core according to claim 1, wherein the metal material is aluminum or aluminum alloy.

3. The center tube core according to claim 1, wherein a part of a side wall of the bead protrudes radially outwardly to form the slide block.

4. The center tube core according to claim 1, wherein the slide block is integrally engaged with the feed thread, or a surface of the slide block is provided with one or more ridges that are engaged with the feed thread.

5. The center tube core according to claim 1, wherein the inner wall of the spiral forms the feed thread by cutting, or the feed thread is formed by deformation of a tube wall of the spiral.

6. The center tube core according to claim 1, wherein an inner wall of the bead is provided with a limiting protrusion for engaging the product.

7. The center tube core according to claim 6, wherein a part of a side wall of the bead is cut to form a tab, and the tab is bent radially inward to form the limiting protrusion.

8. The center tube core according to claim 7, wherein separable portions of the tab from the side wall of the bead comprise three transverses connected in sequence, respectively:

a first transverse extending along a circumferential direction of the bead;

a second transverse extending from one end of the first transverse toward a top end along an axial direction of the bead; and a third transverse extending from an other end of the first transverse toward the top end along the axial direction of the bead.

9. The center tube core according to claim 7, wherein separable portions of the tab from the side wall of the bead comprise three transverses connected in sequence, respectively:

a first transverse extending along an axial direction of the bead;

a second transverse extending from one end of the first transverse in a circumferential direction of the bead; and a third transverse extending from an other end of the first transverse in the circumferential direction of the bead, wherein the second transverse and the third transverse are located at the same side of the first transverse.

10. The center tube core according to claim 1, wherein an inner wall of the inner cylinder is provided with axially extending ribs for engaging with the product, and wherein the ribs are formed by a radially inward depression of a wall of the inner cylinder.

11. A cosmetic packaging tube, comprising a base, a top cover and the center tube core according to claim 1.

12. The cosmetic packaging tube according to claim 11, wherein the prong comprises a first inner section extending into the spiral and a first operation section located axially outside a bottom end of the spiral, wherein the slide slot is defined in the first inner section, the base is fixedly connected with the first operation section, the spiral is at least partially exposed outside the base, and an exposed portion of the spiral has a smooth outer wall surface.

13. The cosmetic packaging tube according to claim 12, wherein a positioning step is provided between the first inner section and the first operation section, and the bottom end of the spiral abuts against the positioning step.

14. The cosmetic packaging tube according to claim 13, wherein an outer peripheral surface of the spiral is flush with an outer peripheral surface of the first operation section.

15. The cosmetic packaging tube according to claim 12, wherein a bottom end of the first operation section is provided with a closing plate.

16. The cosmetic packaging tube according to claim 12, wherein an outer wall of the prong is provided with a positioning groove extending in a circumferential direction, and the inner wall of the spiral is provided with a positioning protrusion engaged with the positioning groove.

17. The cosmetic packaging tube according to claim 11, wherein the prong comprises a first inner section extending into the spiral and a first operation section located axially outside a top end of the spiral, and wherein the slide slot is defined in the first inner section, the spiral is fixedly connected with the base and is accommodated in the base, and wherein the first operation section extends into the top cover.

18. The cosmetic packaging tube according to claim 17, wherein an outer wall of the spiral has a deformation corresponding to the feed thread.

19. The cosmetic packaging tube according to claim 17, wherein the bead is an axially penetrated tubular structure and comprises a product supporting portion and an extension portion distributed in an axial direction of the bead, and wherein the slide block is provided at the extension portion and the tubular structure has a reduced diameter region between the product supporting portion and the extension portion, and the reduced diameter region forms a product stop ring on an inner wall of the tubular structure.

20. The cosmetic packaging tube according to claim 17, wherein a middle sleeve is fixedly inserted into an opened portion of the base, a gap is defined between the middle sleeve and the spiral in an axial direction of the base, which serves as an axial positioning groove, and a positioning ring is inserted into the axial positioning groove and arranged on an outer periphery of the prong.

21. The cosmetic packaging tube according to claim 17, wherein one axial end of the base is provided with an opening for insertion of the prong and an other axial end is provided with a through hole whose periphery is an annular inner flange, and wherein an end of the spiral abuts against the inner flange.

* * * * *